US011654077B2

(12) United States Patent
Hunter

(10) Patent No.: US 11,654,077 B2
(45) Date of Patent: May 23, 2023

(54) BABY ROLLER BURPEE AND SOOTHING MASSAGING DEVICE

(71) Applicant: Samantha G. Hunter, Trinidad, CO (US)

(72) Inventor: Samantha G. Hunter, Trinidad, CO (US)

( * ) Notice: Subject to any disclaimer, the term of this patent is extended or adjusted under 35 U.S.C. 154(b) by 363 days.

(21) Appl. No.: 16/858,114

(22) Filed: Apr. 24, 2020

(65) Prior Publication Data

US 2020/0337940 A1 Oct. 29, 2020

Related U.S. Application Data

(60) Provisional application No. 62/838,574, filed on Apr. 25, 2019.

(51) Int. Cl.
*A61H 15/00* (2006.01)
*A41D 19/00* (2006.01)

(52) U.S. Cl.
CPC ..... *A61H 15/0092* (2013.01); *A41D 19/0013* (2013.01); *A41D 19/0024* (2013.01); *A41D 2400/322* (2013.01); *A61H 2015/0014* (2013.01); *A61H 2201/0153* (2013.01); *A61H 2201/1638* (2013.01); *A61H 2201/1645* (2013.01)

(58) Field of Classification Search
CPC ..... A61H 15/0092; A61H 2015/0014; A61H 2201/0153; A61H 2201/1638; A61H 2201/1645; A61H 2201/1253; A61H 2205/081; A61H 1/00; A41D 19/0013; A41D 19/0024; A41D 2400/322
See application file for complete search history.

(56) References Cited

U.S. PATENT DOCUMENTS 1,755,144 A * 4/1930 Arranz ..... A61H 15/0092 601/118
4,198,723 A * 4/1980 Hiller ..... B05C 17/023 15/230.11
4,314,395 A * 2/1982 Brock ..... E04F 21/22 D8/51
4,577,625 A 3/1986 Lohati et al.
(Continued)

FOREIGN PATENT DOCUMENTS

CN 203576722 U 5/2014
GB 2353711 A 3/2001
JP 3161744 U 8/2010

*Primary Examiner* — Garrett K Atkinson
(74) *Attorney, Agent, or Firm* — Wilmer Cutler Pickering Hale and Dorr LLP

(57) ABSTRACT

A massaging device according to an embodiment of the present disclosure includes: a fastener configured to removably attach to a human hand; a first base non-rotatably attached to the fastener; a second base rotatably attached to the first base, wherein the second base is configured to rotate about a first axis; an interface mechanism configured to permit adjustment of a rotational position of the first base with respect to the second base among two or more rotational positions; a cylinder coupled to the second base, wherein the cylinder is configured to rotate about a second axis, and wherein the first axis and the second axis are not parallel, and wherein the cylinder does not directly contact the first or second bases.

17 Claims, 9 Drawing Sheets

(56) References Cited

U.S. PATENT DOCUMENTS 4,858,916 A * 8/1989 Beaumont ..... A63B 21/065 482/105
4,862,542 A * 9/1989 Jordan ..... A47C 21/00 5/673
5,358,463 A * 10/1994 Fuentes ..... A63B 23/12 482/141
5,386,610 A * 2/1995 Batanjski ..... B05C 17/0242 15/210.1
5,520,616 A * 5/1996 Hofmeister ..... A61H 23/0263 601/80
5,632,707 A * 5/1997 Daniel ..... A63B 22/20 482/141
5,925,077 A * 7/1999 Williamson ..... A61F 2/4609 623/22.34
6,090,055 A * 7/2000 Frajdenrajch ..... A61H 7/008 15/384
6,141,821 A * 11/2000 Chin ..... B05C 17/023 D4/122
6,702,766 B2 * 3/2004 Guitay ..... A61H 15/0085 601/126
7,063,646 B1 * 6/2006 Slimi ..... A63B 22/14 482/141
7,186,909 B2 * 3/2007 Bee, Jr ..... G10C 9/00 84/459
7,387,599 B1 * 6/2008 Hsu ..... A63B 21/0552 601/118
7,468,025 B2 * 12/2008 Hauser ..... A63B 23/1281 482/141
7,481,753 B2 * 1/2009 James ..... A63B 21/4035 482/62
7,503,884 B1 * 3/2009 Schall ..... A63B 23/1209 482/141
7,935,039 B2 * 5/2011 Dannenberg ..... A63B 23/12 482/141
D653,714 S * 2/2012 Meininger ..... D21/662
D654,545 S * 2/2012 Richard ..... D21/662
8,137,251 B2 * 3/2012 Tozzi ..... A63B 22/203 482/141
8,926,482 B2 * 1/2015 Miller, Jr. ..... A63B 21/072 482/141
9,358,419 B1 * 6/2016 Smith ..... A63B 23/1209
9,597,863 B2 * 3/2017 Caiman ..... B29C 65/48
9,744,394 B2 * 8/2017 Frederick ..... A63B 21/4035
9,808,665 B1 * 11/2017 Demarais ..... A63B 21/4035
9,987,791 B2 * 6/2018 Caiman ..... B32B 37/0053
10,723,065 B2 * 7/2020 Caiman ..... B29C 63/0004
10,881,898 B2 * 1/2021 Petersen ..... A63B 21/4035
10,945,913 B2 * 3/2021 Nelson ..... A61H 15/0092
2002/0111256 A1 * 8/2002 Tuller ..... A63B 23/0244 482/140
2003/0134726 A1 * 7/2003 Yu ..... A63B 21/00043 482/110
2003/0158023 A1 * 8/2003 Yu ..... A63B 23/12 482/126
2004/0040111 A1 * 3/2004 Er ..... B05C 17/0217 492/19
2005/0085352 A1 * 4/2005 Baxter ..... A63B 21/0724 482/100
2005/0187498 A1 * 8/2005 Miller ..... A61H 23/0254 601/102
2008/0167168 A1 * 7/2008 Hurst ..... A63B 22/20 482/132
2009/0064436 A1 * 3/2009 Scott, Sr. ..... B05C 17/0217 15/230.11
2010/0216615 A1 * 8/2010 Rios ..... A63B 22/203 482/142
2012/0295775 A1 * 11/2012 Reid ..... A63B 22/20 482/108
2014/0027037 A1 * 1/2014 Caiman ..... B32B 38/10 156/60
2017/0056284 A1 * 3/2017 Kramer ..... A61H 15/0092
2019/0099323 A1 * 4/2019 Nelson ..... A61H 15/00
2019/0105533 A1 * 4/2019 Long ..... A63B 23/1245

* cited by examiner

BABY ROLLER BURPEE AND SOOTHING MASSAGING DEVICE

CROSS-REFERENCE TO RELATED APPLICATIONS

This application claims the benefit of U.S. Provisional Patent Application Ser. No. 62/838,574, filed on Apr. 25, 2019, which is incorporated by reference herein in its entirety for all purposes.

TECHNICAL FIELD

Embodiments of the present disclosure relate generally to massaging devices, and more particularly to a massaging device that can be worn on a user's hand to massage a baby, adult, or animal.

BACKGROUND

Existing techniques for massaging, burping, and soothing babies may be too rough. Massaging techniques and devices may cause irritation for users with textile sensitivity.

SUMMARY

Example 1

A massaging device according to an embodiment of the present disclosure includes: a fastener configured to removably attach to a human hand; a first base non-rotatably attached to the fastener; a second base rotatably attached to the first base, wherein the second base is configured to rotate about a first axis; an interface mechanism configured to permit adjustment of a rotational position of the first base with respect to the second base among two or more rotational positions; a cylinder coupled to the second base, wherein the cylinder is configured to rotate about a second axis, and wherein the first axis and the second axis are not parallel, and wherein the cylinder does not directly contact the first or second bases.

Example 2

The massaging device of Example 1, the interface mechanism comprising a stopping mechanism configured to resist rotation of the second base with respect to the first base at a selected rotational position of the two or more rotational positions.

Example 3

The massaging device of any of Examples 1 to 2, wherein the stopping mechanism comprises a frictional element configured to increase rotational friction between the first and second bases at the selected rotational position.

Example 4

The massaging device of Example 1, wherein the interface mechanism is further configured to maintain the first base and the second base at a selected rotational position of the two or more rotational positions during use of the massaging device.

Example 5

The massaging device of Example 1, wherein the fastener is a mitt.

Example 6

The massaging device of Example 1, wherein the fastener is a strap.

Example 7

The massaging device of any of Examples 1 to 5, wherein the fastener covers up to a distal interphalangeal joint on each finger of the human hand when the fastener is attached to the human hand.

Example 8

The massaging device of Example 1, wherein the fastener is configured to removably attach to a left human hand, and wherein the fastener is configured to removably attach to a right human hand.

Example 9

The massaging device of Example 1, wherein the fastener comprises natural fibers.

Example 10

The massaging device of Example 1, wherein the first base or the second base is circular.

Example 11

The massaging device of Example 1, wherein the cylinder is a first cylinder, the massaging device further comprising a second cylinder coupled to the second base, wherein the second cylinder is configured to rotate about a third axis.

Example 12

The massaging device of Example 1, wherein the cylinder is no more than two cylinders.

Example 13

The massaging device of Example 1, wherein the cylinder comprises a material sufficiently flexible to conform to a baby's back upon application of manual pressure.

Example 14

The massaging device of Example 1, wherein the cylinder is removably coupled to the second base.

Example 15

The massaging device of Example 1, further comprising struts coupling the cylinder with the second base, the struts configured to position the cylinder at the second axis.

Example 16

The massaging device of any of Examples 1 to 15, wherein the struts comprise a material sufficiently flexible to bend upon application of manual pressure.

Example 17

A massaging device according to an embodiment of the present disclosure comprises a fastener configured to removably attach the device to a human hand; a flexible cylinder configured to rotate about an axis; and flexible struts coupling the cylinder and the fastener, the flexible struts configured to separate the cylinder and the fastener and to position the cylinder at the axis.

While multiple embodiments are disclosed, still other embodiments of the present invention will become apparent to those skilled in the art from the following detailed description, which shows and describes illustrative embodiments of the invention. Accordingly, the drawings and detailed description are to be regarded as illustrative in nature and not restrictive.

Figure 1:
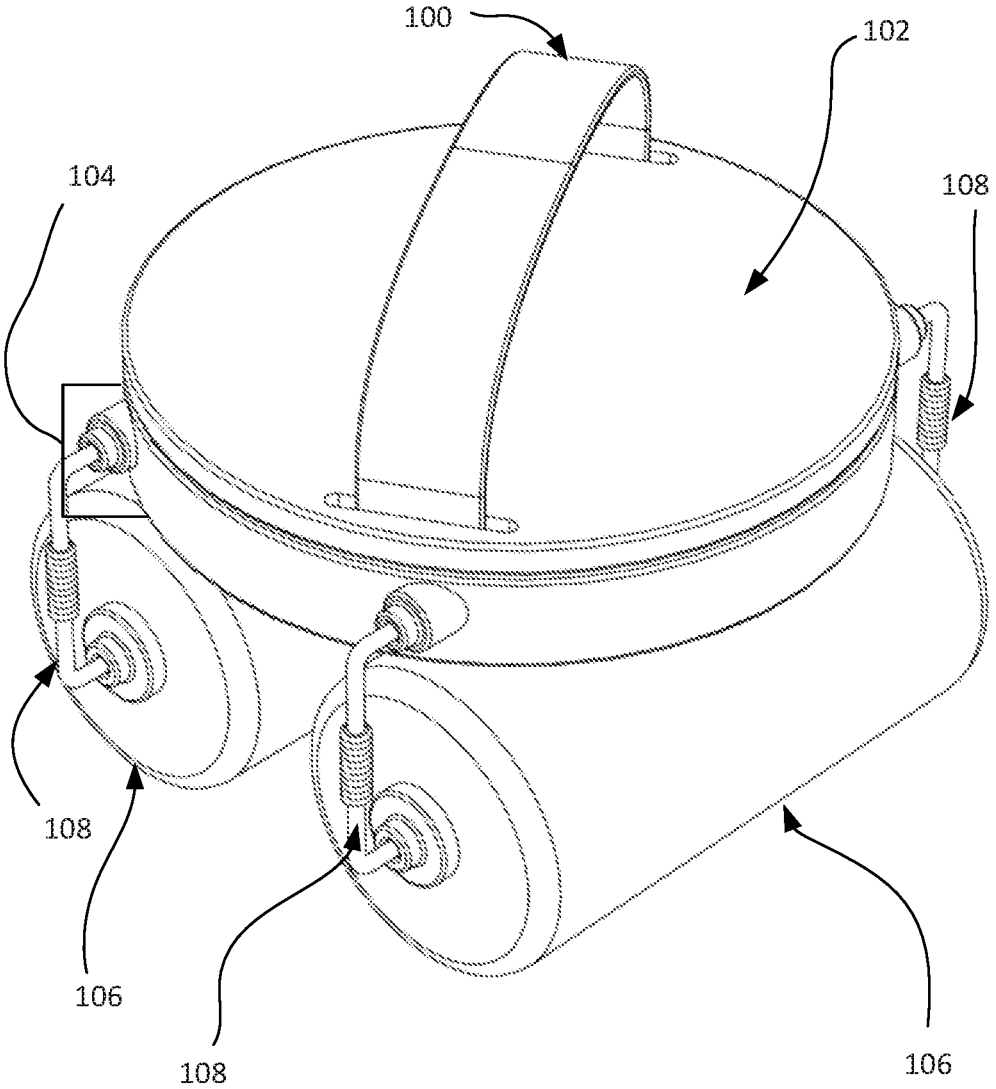
FIG. 1 illustrates a diagonal perspective view of a massaging device according to an embodiment of the present disclosure.

While embodiments of the disclosure are amenable to various modifications and alternative forms, specific embodiments have been shown by way of example in the drawings and are described in detail below. The intention, however, is not to limit the invention to the particular embodiments described. On the contrary, the invention is intended to cover all modifications, equivalents, and alternatives falling within the scope of the invention as defined by the appended claims.

DETAILED DESCRIPTION

FIGS. 1-8 illustrate a massaging device according to an embodiment of the present disclosure. The massaging device may include a strap 100, a first base 102, a second base 104, a cylinder 106, a strut 108, and a stopping mechanism. In some embodiments the stopping mechanism is comprised of a frictional element (as shown) and in other embodiments the stopping mechanism is comprised of a loop portion and a knob portion.

The strap 100 removably attaches to a user's hand. The strap 100 can be made from a variety of materials, including a hook-and-loop fastener.

The massaging device may also include a first base 102 non-rotatably attached to a strap 100; attached, for example, using glue and/or other types of adhesives, a hook-and-loop fastener, snaps, or stitches to prevent the first base 102 from rotating. The first base 102 may be comprised of flexible material, such as foam. The first base 102 may also be comprised of an inflexible material. The first base 102 may be any two-dimensional shape. As illustrated, the first base 102 may be circular. The massaging device may further include a second base 104 positioned between the first base 102 and a cylinder 106. The second base 104 may be comprised of flexible material, such as foam. The second base 104 may also be comprised of an inflexible material. The second base 104 may be any two-dimensional shape. As illustrated, the second base 104 may be circular. The second base 104 may be comprised of multiple layers. The second base 104 may be rotatably attached to the first base 102.

The massaging device may further include a stopping mechanism which serves to stop rotation of the first base. As illustrated, the stopping mechanism may comprise a frictional element. In another embodiment, the stopping mechanism may comprise a snap. In another embodiment, the stopping mechanism may comprise a loop portion and a knob portion. The loop portion may be attached to the first base 102 and the knob portion may be attached to the second base 104. In another embodiment, the loop portion may be attached to the second base 104 and the knob portion may be attached to the first base 102. In one embodiment, the loop portion may be comprised of a flexible band, such as an elastic band. In one embodiment, the knob portion may be comprised of a plastic sphere or a sphere made from a natural material such as wood. The knob portion may be inserted into the loop portion to prevent or reduce rotation of the second base 104 in relation to the first base 102.

The massaging device may further include one or more cylinders 106. In one embodiment, the massaging device may include two cylinders 106. Each cylinder 106 may be comprised of a material sufficiently flexible to conform to the shape of the portion of the baby, adult, or animal to which it is applied upon application of manual pressure. In one embodiment, each cylinder 106 may be comprised of foam.

The second base 104 may be coupled to each cylinder 106 via a strut 108. The struts 108 may be completely comprised of flexible material or may be comprised of part flexible material and part non-flexible material, as shown. The struts 108 may be configured to position the cylinders 106 at the axes about which the cylinders 106 rotate.

Figure 2:
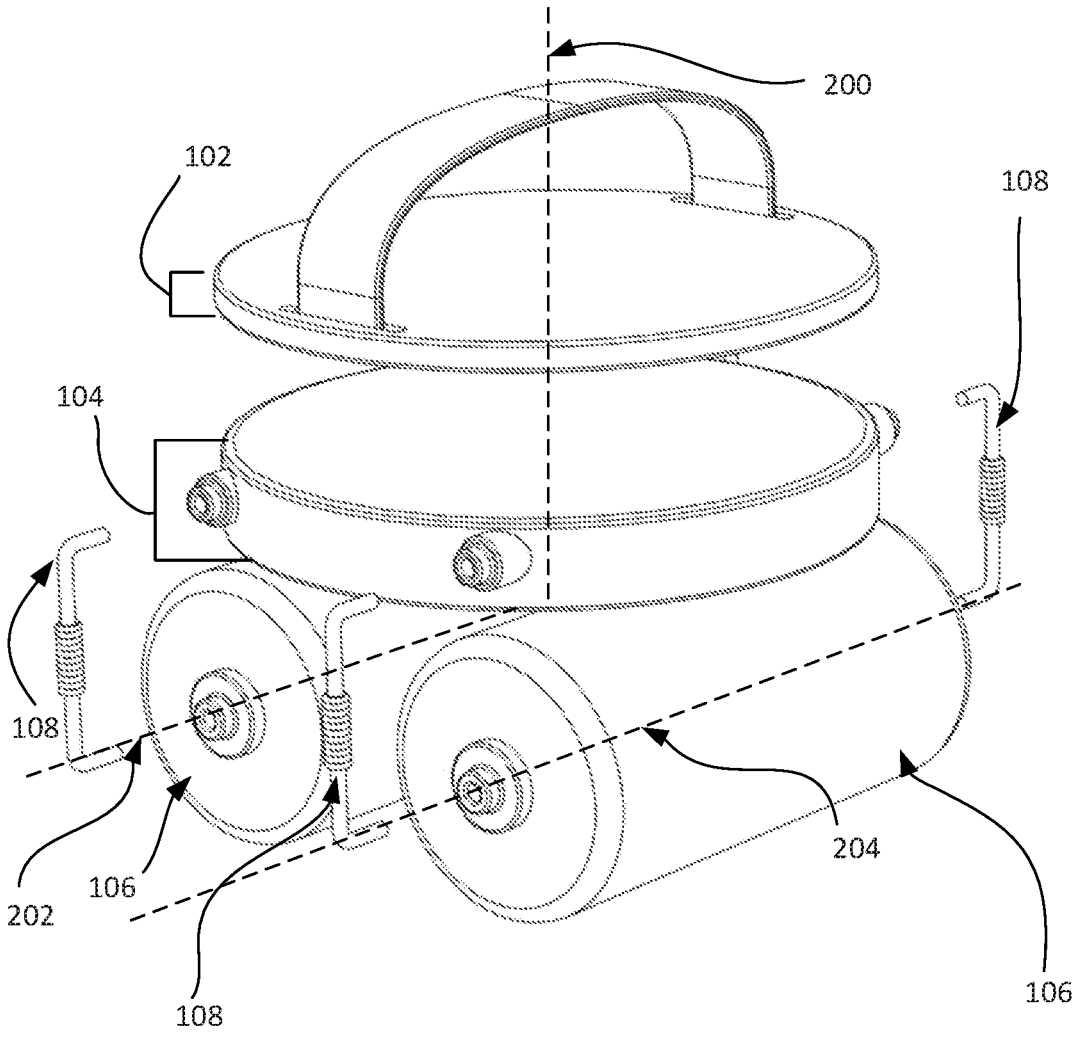
FIG. 2 illustrates a partial cross-sectional view of the massaging device of FIG. 1, with the first base rotated to a first rotational position, according to an embodiment of the present disclosure.

FIG. 2 illustrates a partial cross-sectional view of the massaging device of FIG. 1, according to an embodiment of the present disclosure. First base 102 may be configured to rotate about a first axis 200. The first axis 200 may be perpendicular to the fastener. The first base 102 may rotate about the first axis 200 in any increment from 0 to 360 degrees. Each place where the first base 102 may stop in its rotation about the first axis 200 is a rotational position, according to some embodiments. FIG. 2 illustrates the first base 102 rotated to a first rotational position. The first base 102 may rotate freely about the first axis 200 or may be designed to encounter resistance, such as rotational friction, as it rotates about the first axis 200, facilitating stopping. The user may use the stopping mechanism to select and maintain the first and second base at a selected rotational position. The rotation of the first base 102 about the first axis 200 also allows the cylinders 106, which are indirectly coupled to the second base 104, to be positioned in different directions, according to some embodiments. For example, the cylinders 106 may be positioned horizontally with respect to a body part of a baby, adult, or animal. Alternatively, the cylinders 106 may be positioned vertically with respect to a body part of a baby, adult, or animal. One cylinder 106 may rotate about a second axis 202. The second axis 202 may not be parallel with the first axis. Another cylinder 106 may rotate about a third axis 204. The third axis 204 may not be parallel with the first axis. As illustrated, the struts 108 may be configured to position the cylinders 106 at second axis 202 and third axis 204 about which the cylinders 106 rotate. Each strut 108 may pass through each cylinder 106, or may pass only partially through each cylinder 106, or may not pass through each cylinder 106 at all, as shown, according to some embodiments.

Figure 3:
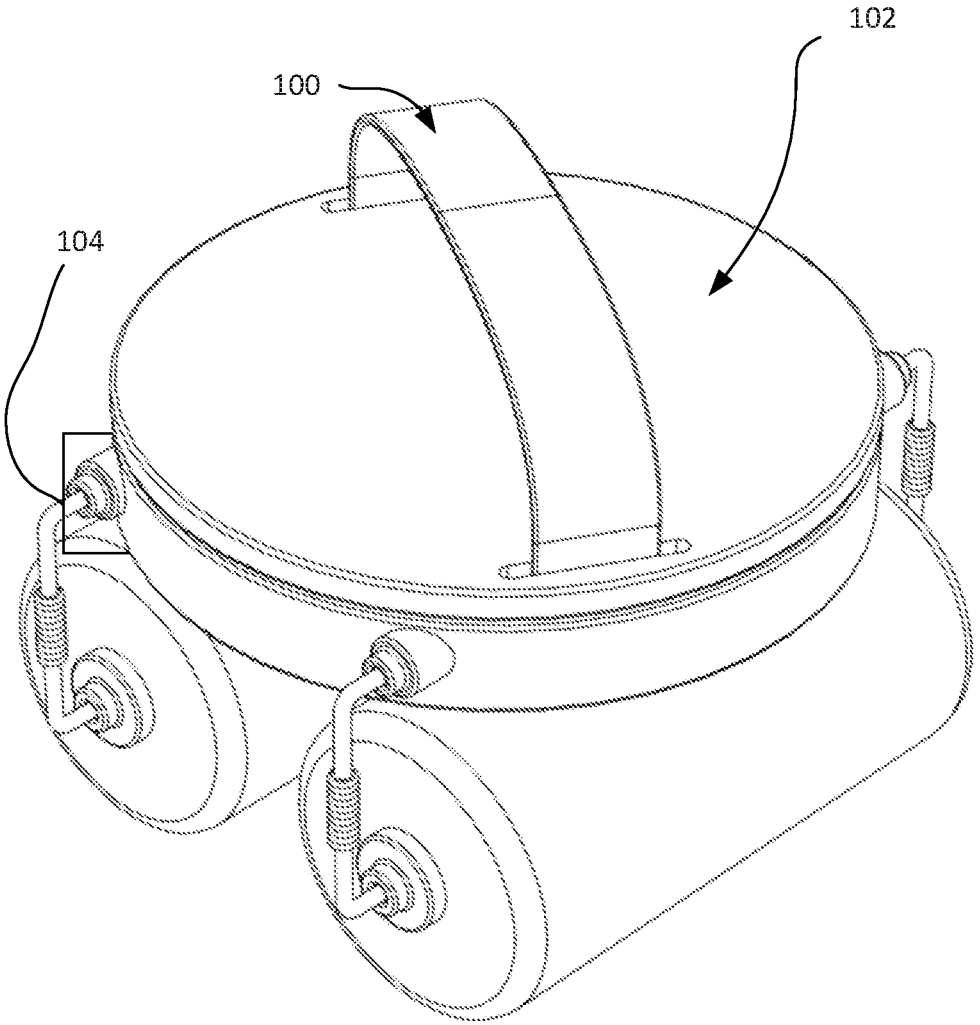
FIG. 3 illustrates a diagonal perspective view of the massaging device of FIG. 1, with the first base rotated to a second rotational position, according to an embodiment of the present disclosure.

FIG. 3 illustrates the massaging device of FIG. 1, according to an embodiment of the present disclosure, with the first base 102 rotated to a second rotational position.

Figure 4:
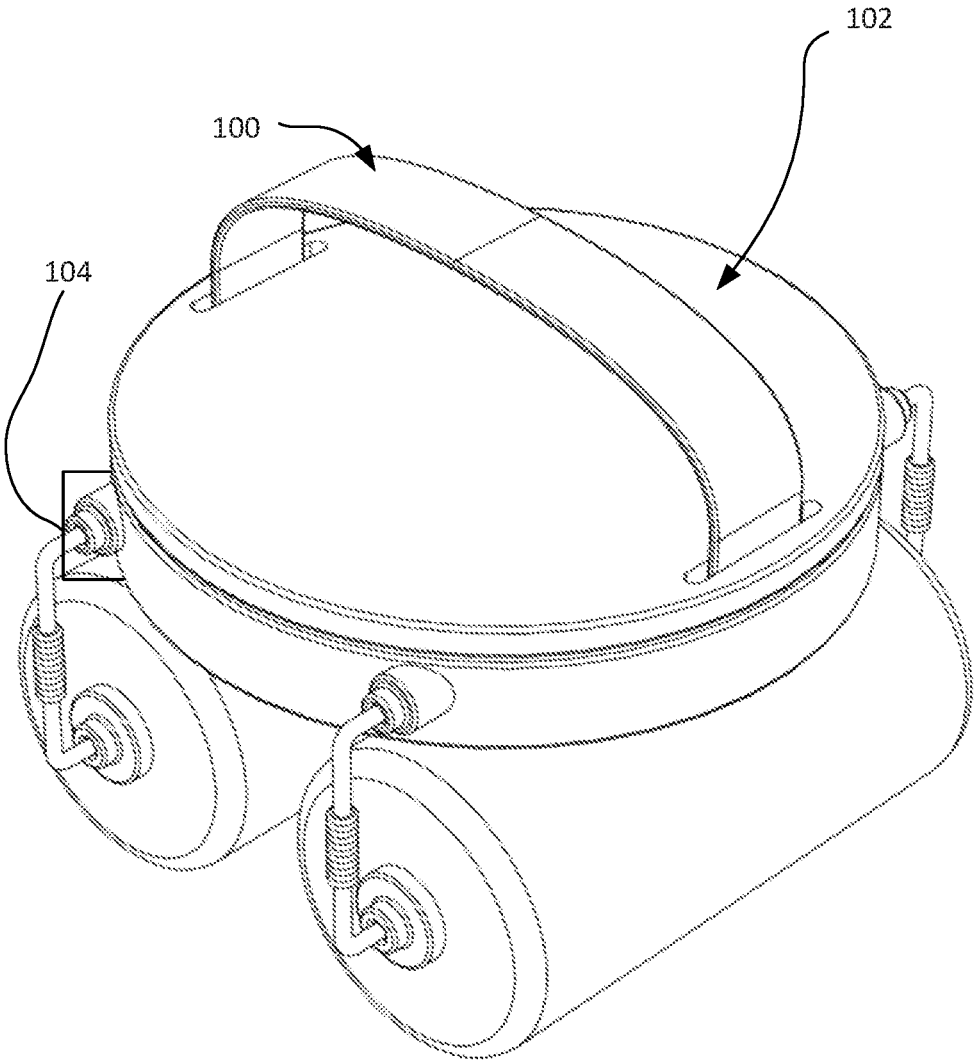
FIG. 4 illustrates a diagonal perspective view of the massaging device of FIG. 1, with the first base rotated to a third rotational position, according to an embodiment of the present disclosure.

FIG. 4 illustrates the massaging device of FIG. 1, according to an embodiment of the present disclosure, with the first base 102 rotated to a third rotational position.

Figure 5:
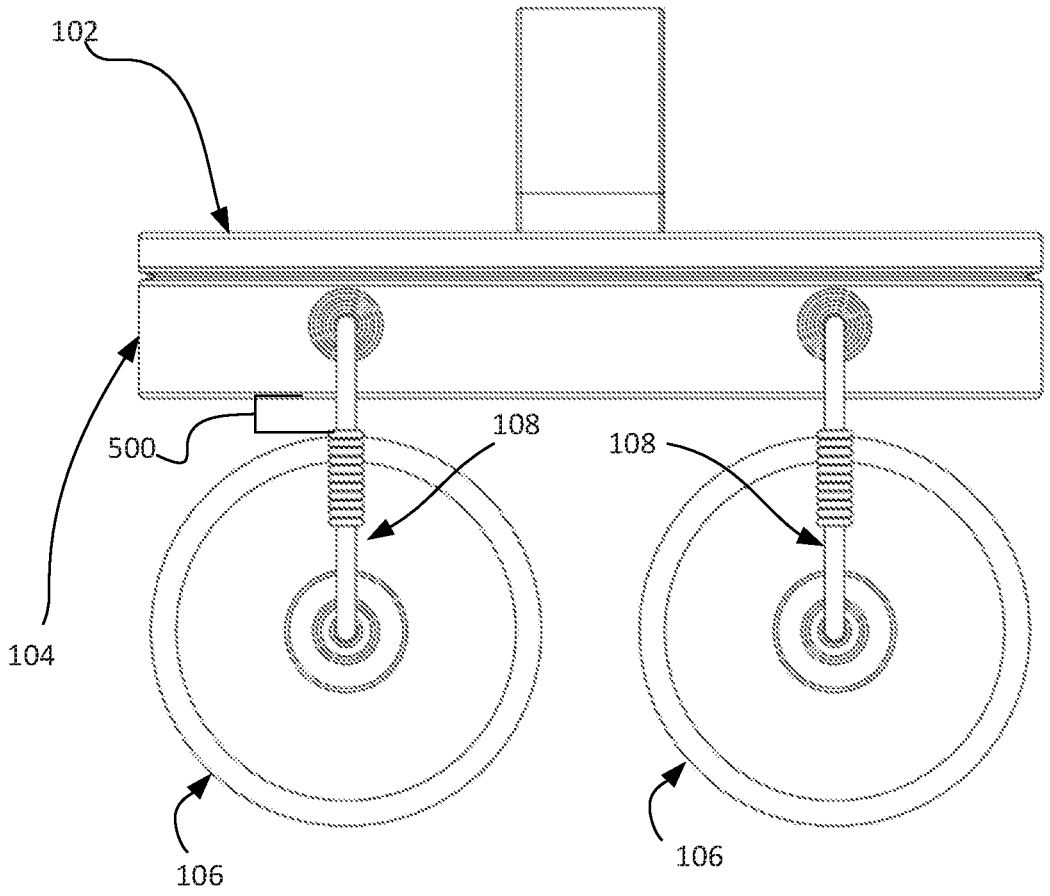
FIG. 5 illustrates a side view of the massaging device of FIG. 1, according to an embodiment of the present disclosure.

FIG. 5 illustrates a side view of the massaging device of FIG. 1, according to an embodiment of the present disclosure. In some embodiments, the struts 108 may couple the cylinder 106 to a second base 104. FIG. 5 illustrates that in some embodiments, the cylinders 106 do not directly contact the second base 104—a space 500 may be maintained by the struts 108.

Figure 6:
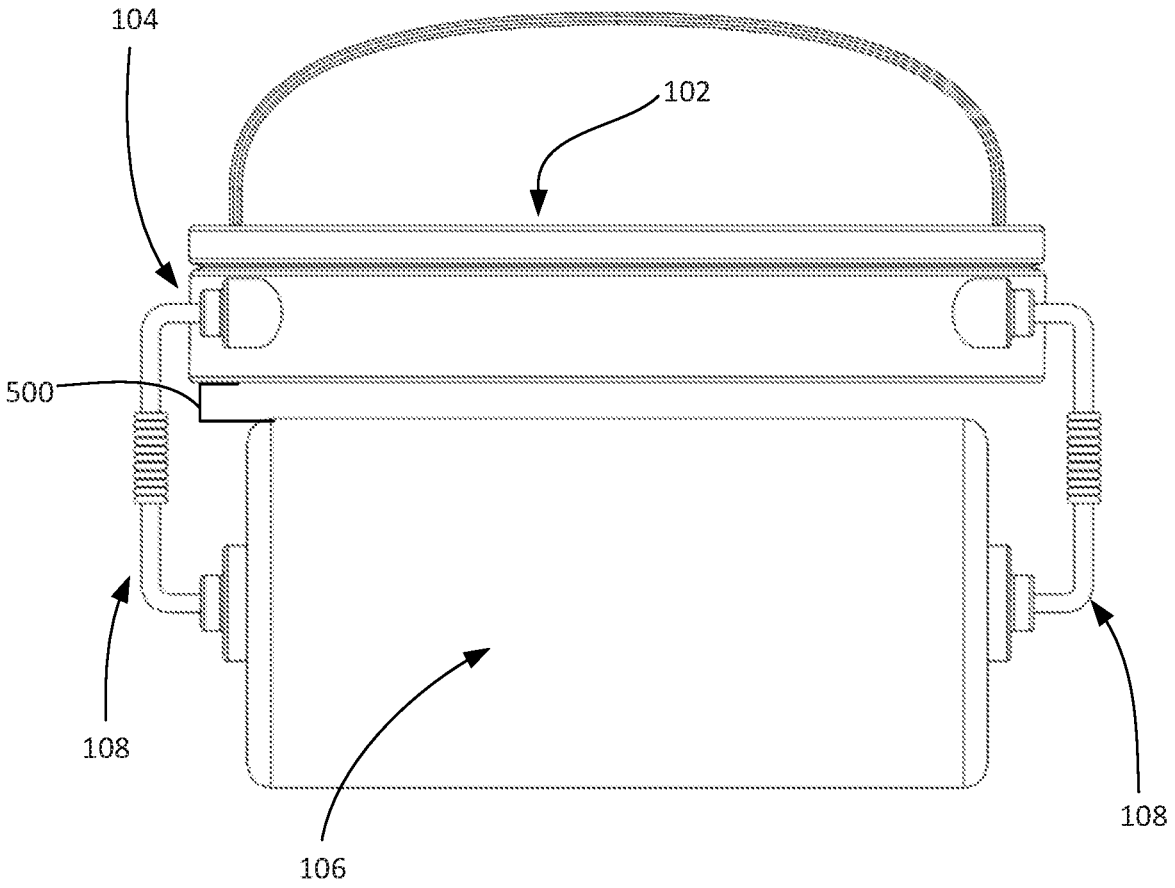
FIG. 6 illustrates a side view of the massaging device of FIG. 1, rotated 90 degrees from the view shown in FIG. 5, according to an embodiment of the present disclosure.

FIG. 6 illustrates a side view of the massaging device of FIG. 1, rotated 90 degrees from the view shown in FIG. 5, according to an embodiment of the present disclosure. In some embodiments, the struts 108 may couple the cylinder 106 to a second base 104. FIG. 6 illustrates that in some embodiments, the cylinders 106 do not directly contact the second base 104—a space 500 may be maintained by the struts 108.

Figure 7:
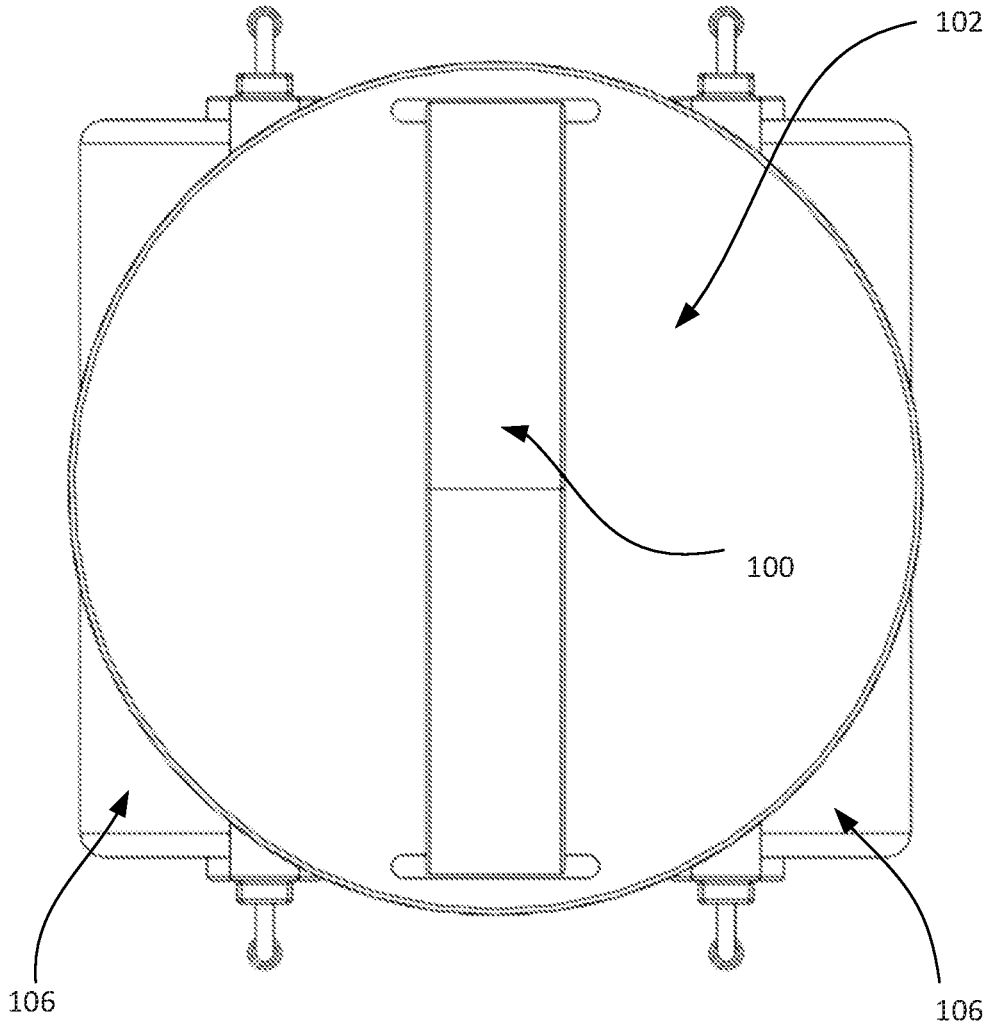
FIG. 7 illustrates a top view of the massaging device of FIG. 1, according to an embodiment of the present disclosure.

FIG. 7 illustrates a top view of the massaging device of FIG. 1, according to an embodiment of the present disclosure.

Figure 8:
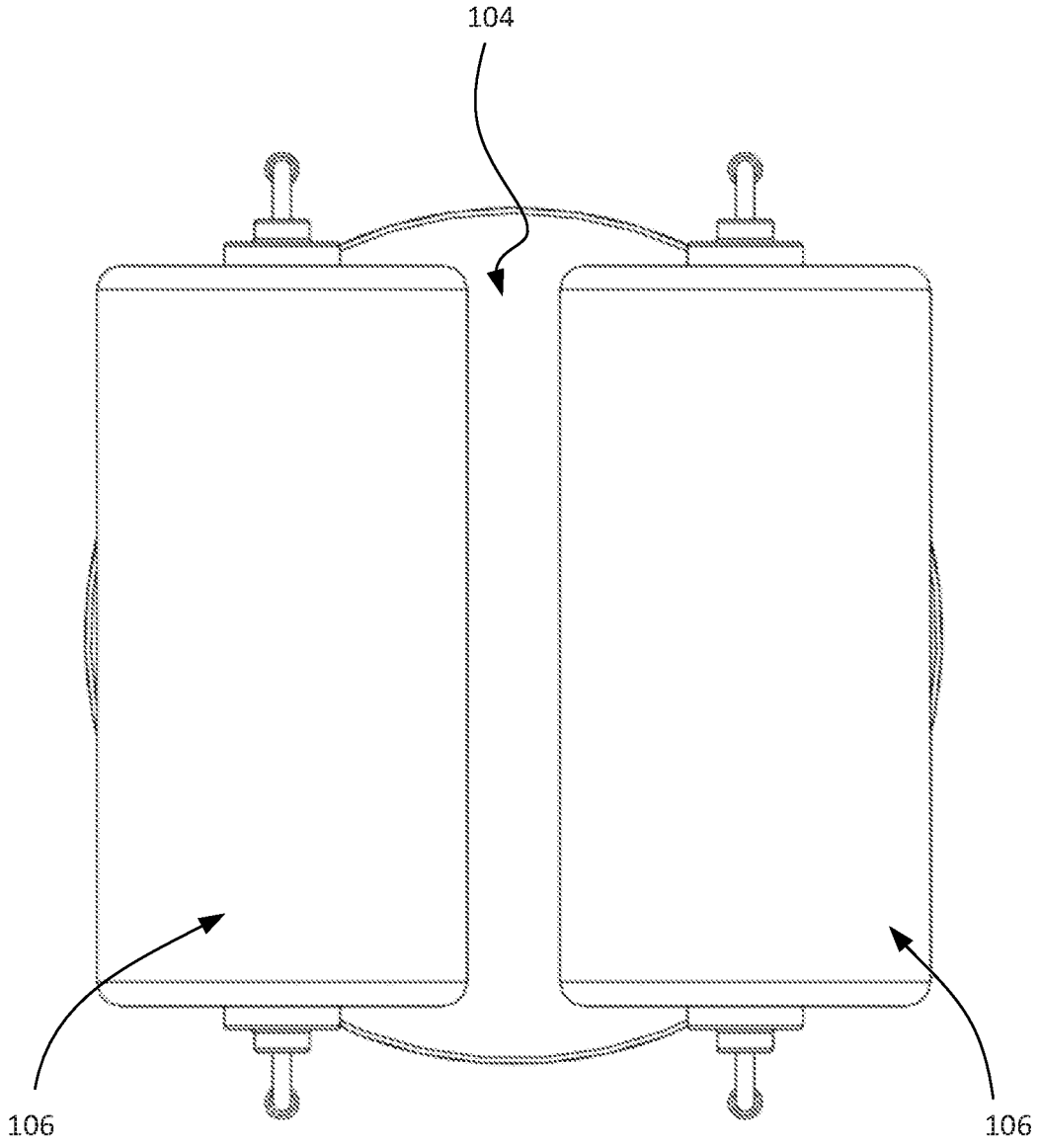
FIG. 8 illustrates a bottom view of the massaging device of FIG. 1, according to an embodiment of the present disclosure.

FIG. 8 illustrates a bottom view of the massaging device of FIG. 1, according to an embodiment of the present disclosure.

Figure 9:
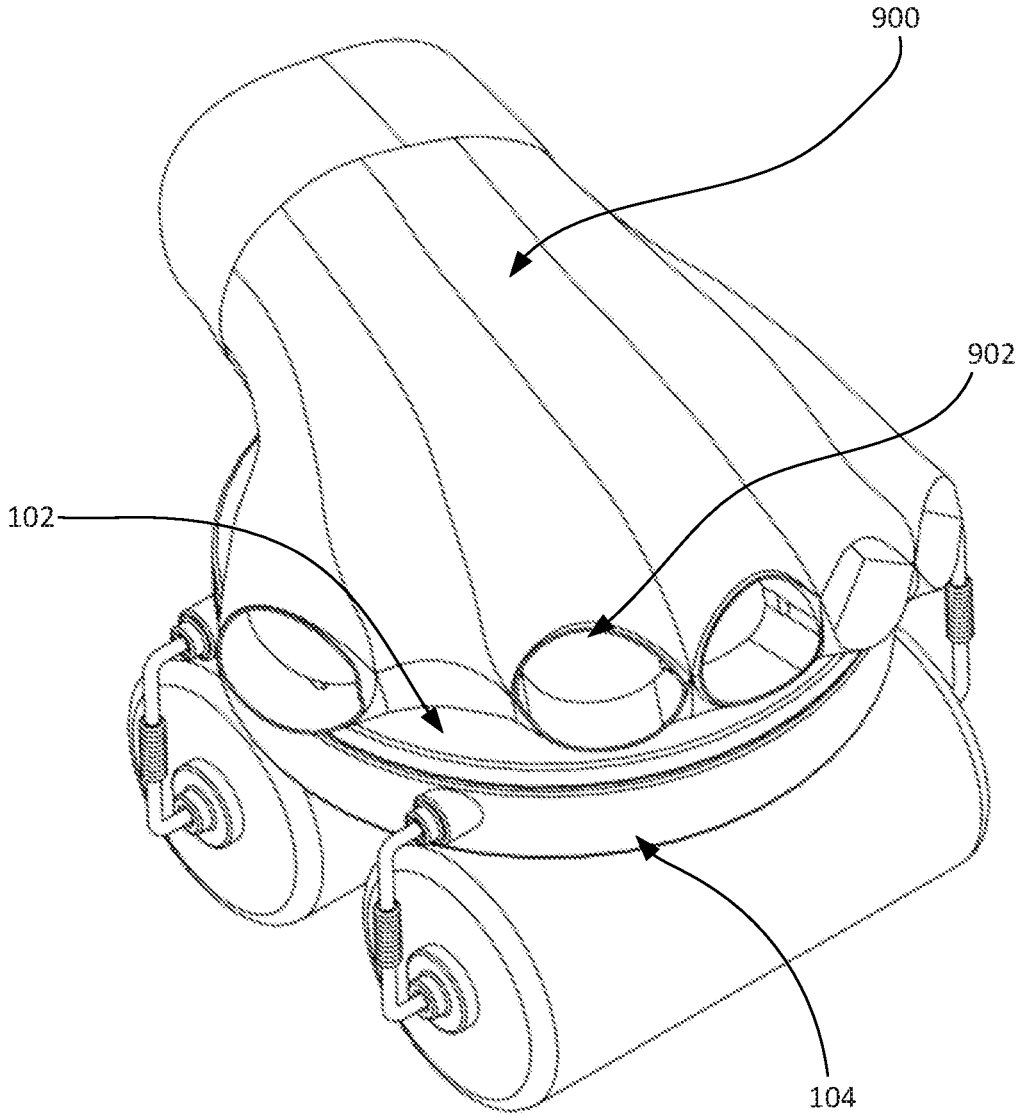
FIG. 9 illustrates a diagonal perspective view of a massaging device according to another embodiment of the present disclosure.

FIG. 9 illustrates another embodiment of a massaging device of the present disclosure. The massaging device may include a mitt 900. The mitt 900 may be a type of fastener which may be configured to removably attach to a human hand, such as by allowing the user to slide a hand into and out of the mitt 900. The mitt 900 may be comprised of a variety of materials, including textiles, rubber, latex, plastic, neoprene, nitrile, vinyl, polyester, or leather. In a preferred embodiment, the mitt may be comprised of natural fibers, such as, for example, cotton, linen, silk, wool, or cashmere.

According to an embodiment of the present disclosure, the massaging device may be removably attached to a left human hand or a right human hand. FIG. 9 illustrates a mitt 900 configured to removably attach to a left human hand. FIG. 9 further illustrates that in some embodiments the mitt 900 may not extend past the distal interphalangeal joint on at least some fingers, leaving the user's fingertips exposed. In some embodiments of the present invention there is an opening 902 where the user's fingertips may be exposed. This may allow the user to directly touch and feel the subject baby, adult, or animal.

Various modifications and additions can be made to the exemplary embodiments discussed without departing from the scope of the present invention. For example, while the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What is claimed is:

1. A massaging device, comprising:
- a fastener configured to removably attach to a human hand;
- a first planar base non-rotatably attached to the fastener, wherein the first base is configured to rotate about a first axis;
- a second planar base rotatably attached to the first base, wherein the second base is configured to rotate about the first axis;
- an interface mechanism permitting adjustment of a rotational position of the first base with respect to the second base among two or more rotational positions;
- a cylinder coupled to the second base and configured to burp and sooth a baby, wherein the cylinder is configured to rotate about a second axis, and wherein the first axis and the second axis are not parallel, and wherein the cylinder does not directly contact the first or second bases.

2. The massaging device of claim 1, the interface mechanism comprising a stopping mechanism capable of resisting rotation of the second base with respect to the first base at a selected rotational position of the two or more rotational positions.

3. The massaging device of claim 2, wherein the stopping mechanism comprises a frictional element configured to increase rotational friction between the first and second bases at the selected rotational position.

4. The massaging device of claim 1, wherein the interface mechanism is further configured to maintain the first base and the second base at a selected rotational position of the two or more rotational positions during use of the massaging device.

5. The massaging device of claim 1, wherein the fastener is a mitt.

6. The massaging device of claim 5, wherein the fastener covers up to a distal interphalangeal joint on each finger of the human hand when the fastener is attached to the human hand.

7. The massaging device of claim 1, wherein the fastener is a strap.

8. The massaging device of claim 1, wherein the fastener is configured to removably attach to a left human hand, and wherein the fastener is configured to removably attach to a right human hand.

9. The massaging device of claim 1, wherein the fastener comprises natural fibers.

10. The massaging device of claim 1, wherein the first base or the second base is circular.

11. The massaging device of claim 1, wherein the cylinder is a first cylinder, the massaging device further comprising a second cylinder coupled to the second base, wherein the second cylinder is configured to rotate about a third axis.

12. The massaging device of claim 1, wherein the cylinder is no more than two cylinders.

13. The massaging device of claim 1, wherein the cylinder comprises a material sufficiently flexible to conform to a baby's back upon application of manual pressure.

14. The massaging device of claim 1, wherein the cylinder is removably coupled to the second base.

15. The massaging device of claim 1, further comprising struts coupling the cylinder with the second base, the struts configured to position the cylinder at the second axis.

16. The massaging device of claim 15, wherein the struts comprise a material sufficiently flexible to bend upon application of manual pressure.

17. A massaging device, comprising:

a fastener configured to removably attach the device to a human hand, wherein the fastener is configured to rotate about a first axis;

a flexible cylinder configured to burp and sooth a baby and rotate about a second axis, wherein the first axis and the second axis are not parallel; and a first planar base non-rotatably attached to the fastener, wherein the first base is configured to rotate about the first axis; a second planar base rotatably attached to the first base, wherein the second base is configured to rotate about the first axis; and flexible struts coupling the cylinder and the fastener, the flexible struts configured to separate the cylinder and the fastener and to position the cylinder at the second axis, and wherein the cylinder does not directly contact the first or second bases.

* * * * *